US010036363B2

(12) United States Patent
Sano

(10) Patent No.: US 10,036,363 B2
(45) Date of Patent: Jul. 31, 2018

(54) IGNITION COIL FOR INTERNAL COMBUSTION ENGINE

(71) Applicant: DENSO CORPORATION, Kariya, Aichi-pref. (JP)

(72) Inventor: Masafuyu Sano, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/524,004

(22) PCT Filed: Nov. 2, 2015

(86) PCT No.: PCT/JP2015/080881
§ 371 (c)(1),
(2) Date: May 3, 2017

(87) PCT Pub. No.: WO2016/072373
PCT Pub. Date: May 12, 2016

(65) Prior Publication Data

US 2017/0328332 A1 Nov. 16, 2017

(30) Foreign Application Priority Data

Nov. 5, 2014 (JP) ..... 2014-224835

(51) Int. Cl.
*F02P 3/05* (2006.01)
*F02P 15/12* (2006.01)
(Continued)

(52) U.S. Cl.
CPC ..... *F02P 3/0556* (2013.01); *F02P 13/00* (2013.01); *F02P 15/12* (2013.01); *H01F 27/425* (2013.01);
(Continued)

(58) Field of Classification Search
CPC .. F02P 3/05; F02P 3/055; F02P 3/0556; F02P 9/007; F02P 13/00; F02P 15/12; H01F 27/306; H01F 27/425; H01F 38/12
(Continued)

(56) References Cited

U.S. PATENT DOCUMENTS 5,419,300 A * 5/1995 Maruyama ..... F02P 3/02 123/634
2006/0260591 A1* 11/2006 Iwa ..... F02P 3/02 123/634

(Continued)

FOREIGN PATENT DOCUMENTS

JP 6-58237 3/1994
JP 2006-291874 10/2006
JP 2013-062471 4/2013

*Primary Examiner* — John Kwon
*Assistant Examiner* — Johnny H Hoang
(74) *Attorney, Agent, or Firm* — Nixon & Vanderhye PC

(57) ABSTRACT

In an ignition coil for an internal combustion engine, a coil case includes a housing section and a high-voltage tower section. The housing section houses a primary coil, a secondary coil, a center core, and an outer peripheral core, and is arranged outside a plug hole in a cylinder of an internal combustion engine in which an ignition plug is arranged. The high-voltage tower section protrudes from the housing section, and is disposed within the plug hole. A pole joint is disposed within the plug hole, and is mounted to the high-voltage tower section via a seal rubber. The pole joint is provided with a rib that protrudes to an outer periphery and faces an inner peripheral surface of the plug hole. The inner peripheral side of the rib faces the high-voltage tower section via the seal rubber.

15 Claims, 7 Drawing Sheets

(51) Int. Cl.

| | |
|---|---|
| ***F02P 3/055*** | (2006.01) |
| ***F02P 13/00*** | (2006.01) |
| ***H01F 27/42*** | (2006.01) |
| *F02P 9/00* | (2006.01) |
| *H01F 38/12* | (2006.01) |
| *H01F 27/30* | (2006.01) |

(52) U.S. Cl.
CPC ..... *F02P 9/007* (2013.01); *H01F 27/306* (2013.01); *H01F 38/12* (2013.01)

(58) Field of Classification Search
USPC ..... 123/143 B, 143 R, 143 C, 146.5, 169 R, 123/620, 627, 634; 336/65, 107, 192, 336/198, 220–223
See application file for complete search history.

(56) References Cited

U.S. PATENT DOCUMENTS

| | | | | |
|---|---|---|---|---|
| 2016/0115935 | A1* | 4/2016 | Tada | F02P 3/04 315/209 T |
| 2016/0211072 | A1* | 7/2016 | Kawai | H01F 38/12 |
| 2017/0040104 | A1* | 2/2017 | Akimoto | F02P 3/02 |

* cited by examiner

IGNITION COIL FOR INTERNAL COMBUSTION ENGINE

CROSS-REFERENCE TO RELATED APPLICATION

This application is a U.S. National Phase Application under 35 U.S.C. 371 of International Application No. PCT/JP2015/080881 filed on Nov. 2, 2015 and published in Japanese as WO 2016/072373 A1 on May 12, 2016. This application is based on and claims the benefit of priority from Japanese Patent Application No. 2014-224835, filed Nov. 5, 2014. The entire disclosures of all of the above applications are incorporated herein by reference.

TECHNICAL FIELD

The present invention relates to an ignition coil for an internal combustion engine that generates a spark for ignition in an ignition plug.

BACKGROUND ART

Some ignition coils for internal combustion engines include a coil section that is disposed outside a plug hole. The coil section includes a primary coil and a secondary coil. The secondary coil includes a high-voltage winding end portion that is connected to an ignition coil disposed within the plug hole using a pole joint or the like.

For example, PTL 1 discloses a structure of an ignition coil device for an internal combustion engine in which a high-voltage tower of an ignition coil and a spark plug in a plug hole are connected to each other by a high-voltage joint. A protrusion is formed to protrude in an outer periphery of the high-voltage joint. The protrusion is pressure-welded to the inner peripheral surface of the plug hole so that the high-voltage joint is located at a center of the plug hole.

CITATION LIST

Patent Literature

[PTL 1] JP-A-H06-058237

SUMMARY OF INVENTION

Technical Problem

In the structure of the conventional ignition coil, a mounting flange section provided in the coil section is fastened to the internal combustion engine by a bolt or the like and thus, an ignition coil is mounted to an internal combustion engine. Thus, the ignition coil is not designed to be sufficiently strongly resistant to vibration generated in the internal combustion engine.

In PTL 1, the protrusion of the high-voltage tower is pressure-welded to the inner peripheral surface of the plug hole. The protrusion is configured by a rubber material. A deformation allowable space using a clearance groove is formed on an inner peripheral side of a section in which the protrusion is formed in the high-voltage joint. When the ignition coil is inserted into the plug hole, the protrusion can be deformed by using the deformation allowable space, so that the insertion load of the ignition coil to the plug hole is reduced. Thus, rigidity of the protrusion in the ignition coil inserted into the plug hole is low, thereby making it difficult to improve vibration resistance of the ignition coil.

The present invention has been made in view of the above-described issues. The present invention provides an ignition coil for an internal combustion engine that is capable of improving vibration resistance against vibration generated in an internal combustion engine.

Solution to Problem

An embodiment of the present invention provides an ignition coil for an internal combustion engine, the ignition coil including: a primary coil and a secondary coil; a center core that is arranged on an inner periphery of the primary coil and the secondary coil; an outer peripheral core that is arranged on an outer periphery of the primary coil and the secondary coil; a coil case that is made of resin, the coil case including a housing section and a high-voltage tower section, the housing section housing the primary coil, the secondary coil, the center core, and the outer peripheral core, the housing section being arranged outside a plug hole of a cylinder for the internal combustion engine in which an ignition plug is arranged, the high-voltage tower section being disposed in the housing section such that at least a section of the high-voltage tower section is located within the plug hole; a rubber seal that is made of rubber, the rubber seal being attached to an outer periphery of the high-voltage tower section; a pole joint that is made of resin, the pole joint being disposed in the plug hole and attached to the high-voltage tower section via the rubber seal; and a plug cap that is made of rubber, the plug cap being attached to a distal end side portion of the pole joint and attached to the ignition plug. The pole joint is provided with a rib that protrudes toward an outer periphery of the rib and faces an inner peripheral surface of the plug hole. An inner peripheral side of the rib faces the high-voltage tower section via the rubber seal.

Advantageous Effects of Invention

The ignition coil for an internal combustion engine (hereinafter simply referred to as an ignition coil) as configured above is designed to be sufficiently strongly resistant to vibration generated in the internal combustion engine. Specifically, the rib is disposed on the pole joint made of resin, and an inner periphery of the rib faces the high-voltage tower section made of resin via the rubber seal made of rubber.

The outer diameter of the rib in the pole joint is formed to be slightly smaller than the inner diameter of the plug hole in order to allow the rib of the pole joint to be inserted into the plug hole. In a state where the pole joint is inserted into the plug hole, a slight gap is formed between the rib and the inner peripheral surface of the plug hole. Here, when a mounting flange section in the ignition coil is fastened to the internal combustion engine by a bolt or the like, a center position of the ignition coil relative to the plug hole is slightly deviated due to the fastening force. Thus, the rib of the pole joint abuts on an inner peripheral surface of the plug hole. As a result, the rib of the pole joint made of resin is supported on the inner peripheral surface of the plug hole.

When the internal combustion engine is operated, the ignition coil is strongly vibrated by vibration generated in the internal combustion engine. At this time, the rib of the pole joint is supported on the inner peripheral surface of the plug hole. Thus, swing of the high-voltage tower section disposed in the coil case can be restrained by the inner peripheral surface of the plug hole. In addition, swing of the high-voltage tower section can be suppressed via the rubber seal. This enables the ignition coil to be sufficiently strongly resistant to vibration generated in the internal combustion engine. As a result, according to the ignition coil for the internal combustion engine, vibration resistance against vibration generated in the internal combustion engine can be improved.

DESCRIPTION OF EMBODIMENTS

An ignition coil for an internal combustion engine according to an embodiment will be described below with reference to the drawings. In the following drawings, reference signs L, R, and CR respectively indicate a center axis direction, a radial direction, and a circumferential direction of: a plug hole that is disposed in each cylinder of an engine used as an internal combustion engine; and each member (each component) of an ignition coil for an internal combustion engine that is arranged in the plug hole.

(Embodiment)

Figure 1:
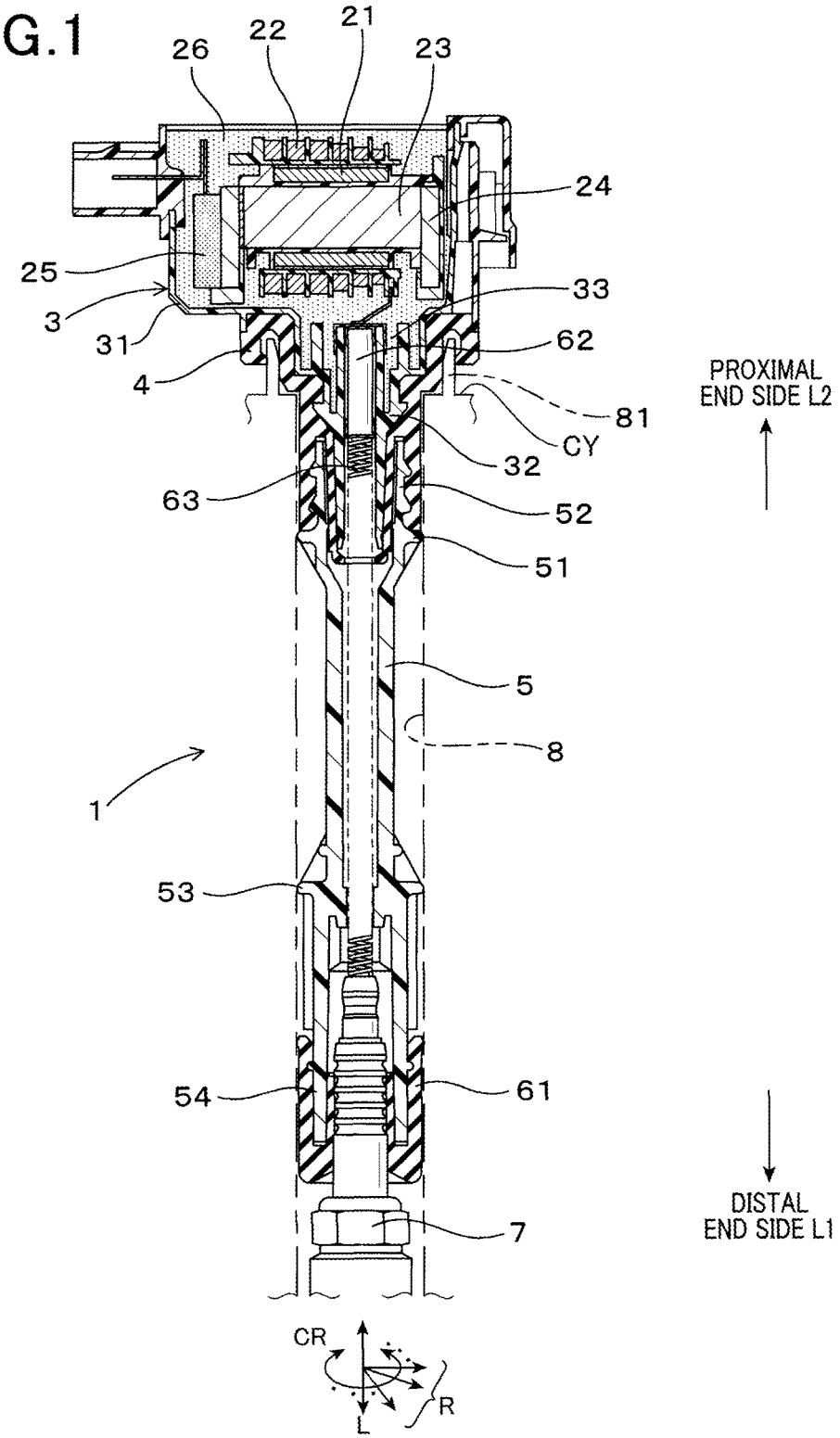
FIG. 1 is an overall cross-sectional view showing an ignition coil for an internal combustion engine according to an embodiment.
Figure 2:
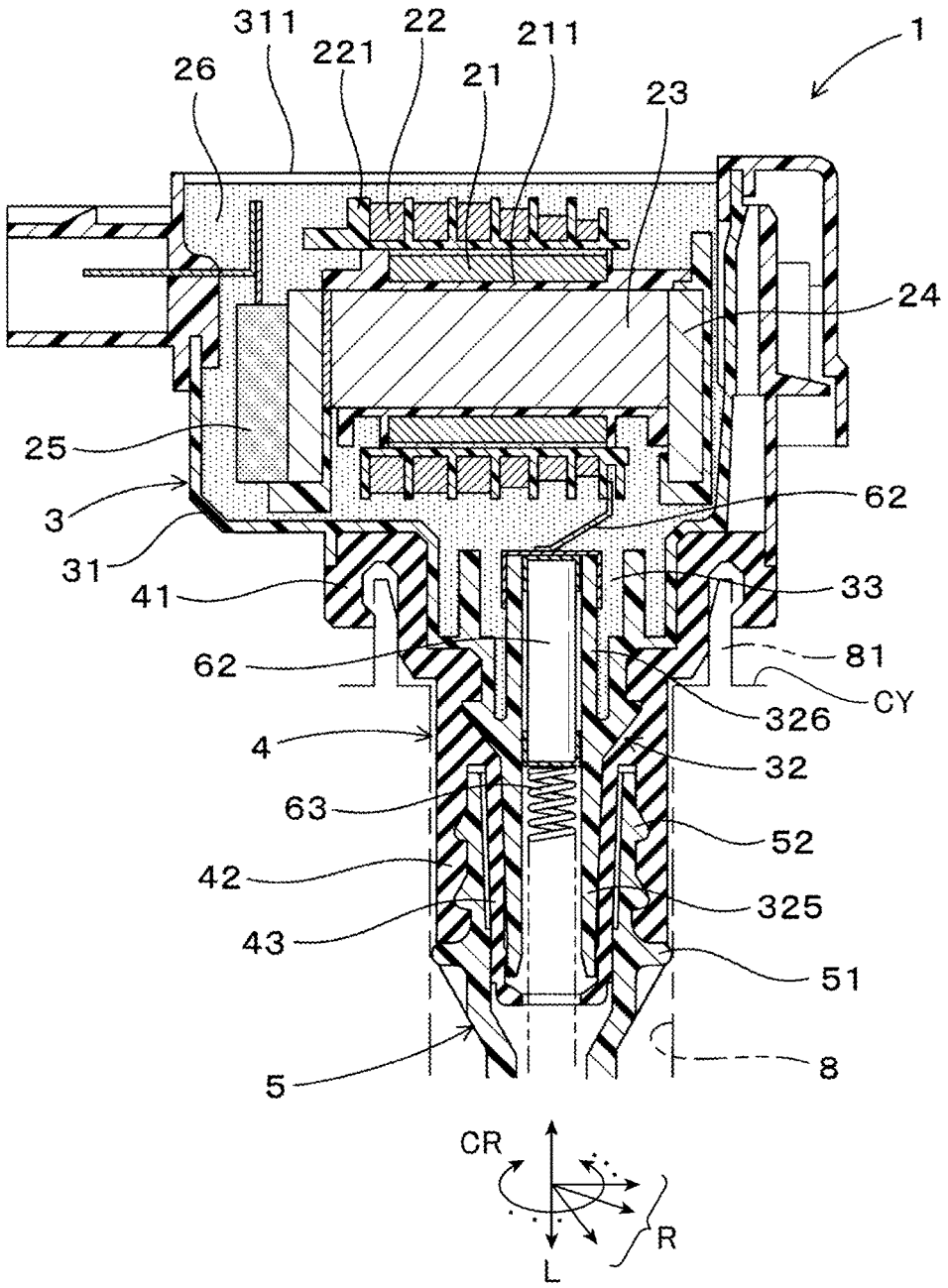
FIG. 2 is a cross-sectional view showing the periphery of the body portion of the ignition coil for an internal combustion engine according to the embodiment.

As shown in FIGS. 1 and 2, an ignition coil 1 for an internal combustion engine (hereinafter, referred to as an ignition coil 1) includes a primary coil 21, a secondary coil 22, a center core 23, an outer peripheral core 24, a coil case 3, a rubber seal 4, a pole joint 5, and a plug cap 61.

The primary coil 21 and the secondary coil 22 are concentrically arranged so as to overlap each other in inner and outer peripheries. The center core 23 is composed of a soft magnetic material, and is arranged in the inner periphery of the primary coil 21 and the secondary coil 22. The outer peripheral core 24 is composed of a soft magnetic material, and is arranged in the outer periphery of the primary coil 21 and the secondary coil 22. The coil case 3 is composed of a resin material, and includes a housing section 31 and a high-voltage tower section 32. The housing section 31 is configured to house the primary coil 21, the secondary coil 22, the center core 23, and the outer peripheral core 24 and to be arranged outside a plug hole 8 of a cylinder CY. The high-voltage tower section 32 is disposed in the housing section 31 such that at least a part of the high-voltage tower section 32 is arranged within the plug hole 8 of the cylinder CY.

The rubber seal 4 is composed of a rubber material, and is configured to seal a space between the outer periphery of the high-voltage tower section 32 and the opening end portion 81 of the plug hole 8 of the cylinder CY. The pole joint 5 is composed of a resin material. The pole joint 5 is arranged in the plug hole 8 of the cylinder CY, and is mounted to the high-voltage tower section 32 via the rubber seal 4. The plug cap 61 is composed of a rubber material. The plug cap 61 is mounted to the distal end side portion of the pole joint 5, and is attached to the ignition plug 7.

Figure 3:
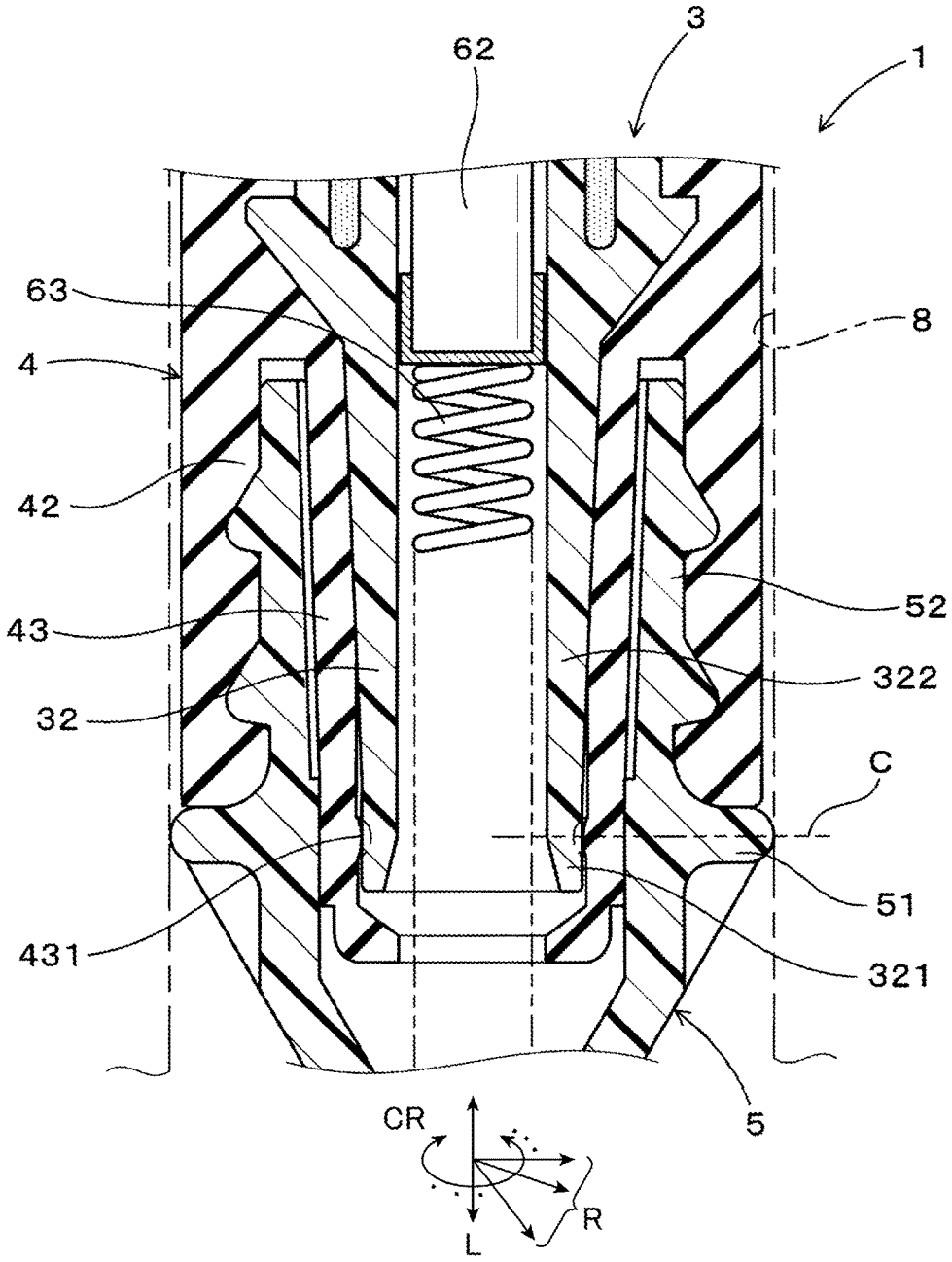
FIG. 3 is a cross-sectional view showing the periphery of a high-voltage tower section in the ignition coil for an internal combustion engine according to the embodiment.

As shown in FIG. 3, the pole joint 5 is provided with a rib 51 that protrudes in the outer periphery and faces the inner peripheral surface of the plug hole 8 of the cylinder CY. The inner peripheral side of the rib 51 faces the high-voltage tower section 32 via the rubber seal 4.

The ignition coil 1 of the present embodiment will be described in detail with reference to FIGS. 1 to 7.

As shown in FIG. 1, the ignition coil 1 is arranged on each cylinder CY of an engine used as an internal combustion engine, and is used for generating a spark in the ignition plug 7 that is arranged in the plug hole 8 of each cylinder CY. The housing section 31 of the primary coil 21, the secondary coil 22, the center core 23, the outer peripheral core 24, and the coil case 3, and a part of the rubber seal 4, or the like are arranged outside the plug hole 8. The high-voltage tower section 32 of the coil case 3, a part of the rubber seal 4, the pole joint 5, and the plug cap 61, or the like are arranged within the plug hole 8.

As shown in FIG. 2, the primary coil 21 is wound around the outer periphery of a primary spool 211 having a square cylinder shape in cross section of which a corner portion is rounded. The secondary coil 22 is wound around an outer periphery of a secondary spool 221 having a square cylinder shape in cross section of which a corner portion is rounded. The center core 23 and the outer peripheral core 24 are formed by laminating a plurality of electromagnetic steel plates exhibiting soft magnetism. The primary spool 211 around which the primary coil 21 is wound is arranged in the outer periphery of the center core 23. The secondary spool 221 around which the secondary coil 22 is wound is arranged in the outer periphery of the primary spool 211. The center core 23, the primary coil 21, the primary spool 211, the secondary coil 22, and the secondary spool 221 are arranged in the inner periphery of the outer peripheral core 24.

The center core 23, the primary coil 21, the primary spool 21, the secondary coil 22, the secondary spool 221, and the outer peripheral core 24 are arranged in the housing section 31 of the coil case 3. In the housing section 31 of the coil case 3, an igniter 25 is arranged to face the outer surface of the outer peripheral core 24. A switching circuit is disposed in the igniter 25 to energize the primary coil 21 and interrupt the energization to the primary coil 21. A gap in the housing section 31 is filled with a casting resin 26 such as a thermosetting resin.

A mounting flange section (not shown) is disposed in the coil case 3. The mounting flange section mounts the ignition coil 1 to an engine (for example, a cylinder head cover or the like). The ignition coil 1 of the present embodiment is supported in the plug hole 8 of the cylinder CY by: mounting to the engine using the mounting flange section; and abutment between an inner peripheral surface of the plug hole 8 in the cylinder CY and the rib 51 of the pole joint 5.

As shown in FIG. 2, the high-voltage tower section 32 includes an outward protrusion section 325 and an inward protrusion section 326 so as to be arranged within the plug hole 8 of the cylinder CY. The outward protrusion section 325 protrudes toward outward from the housing section 31. The inward protrusion section 326 protrudes toward the inside of the housing section 31. A conductive member 62 is arranged in the housing section 31 and high-voltage tower section 32 of the coil case 3. The conductive member 62 is electrically connected to a high-voltage winding end portion of the secondary coil 22. In the housing section 31, a groove section 33 is disposed around the inward protrusion section 326 of the high-voltage tower section 32. The groove section 33 is filled with the casting resin 26. Thus, rigidity of the high-voltage tower section 32 can be increased by the groove section 33 filled with the casting resin 26.

A spring 63 is arranged in the pole joint 5. The spring 63 electrically connects the conductive member 62 and the ignition plug 7. The high-voltage winding end portion of the secondary coil 22 is electrically conductive to the ignition plug 7 via the conductive member 62 and the spring 63.

The high-voltage tower section 32 is formed to protrude toward an opposite side to a side in which an opening section 311 of the housing section 31 is formed, with respect to the housing section 31 in the coil case 3. The high-voltage tower section 32 has a cylindrical shape and protrudes from the housing section 31 in the coil case 3. A straight outer peripheral section 321 is formed in the distal end side portion of the high-voltage tower section 32. The straight outer peripheral section 321 includes an outer peripheral surface that is parallel to a center axis direction L of the plug hole 8 in the cylinder CY. A tapered outer peripheral section 322 is formed to be adjacent to a proximal end side L2 of the straight outer peripheral section 321. The tapered outer peripheral section 322 includes an outer peripheral surface of which a diameter is enlarged toward the proximal end side L2.

As shown in FIG. 1, the pole joint 5 includes a joint engagement section 52 in a proximal end side portion attached to the rubber seal 4 and another joint engagement section 54 in a distal end side portion attached to the plug cap 61. The joint engagement section 52 includes a plurality of protrusion sections that are arranged the center axis direction L of the plug hole 8 in the cylinder CY and protrude toward the outer peripheral side. The other joint engagement section 54 includes a protrusion section that protrudes toward the outer peripheral side.

Here, a distal end side L1 of the present embodiment refers to a back side that is a side where the ignition plug 7 is arranged in the center axis direction L of the plug hole 8 in the cylinder CY. A proximal end side L2 of the present embodiment refers to a front side that is a side of the opening end portion 81 of the plug hole 8 in the cylinder CY in the center axis direction L of the plug hole 8 in the cylinder CY.

The rib 51 in the pole joint 5 is disposed adjacent to the distal end side L1 of the joint engagement section 52. The other rib 53 is disposed at a position between the rib 51 of the pole joint 5 and the other joint engagement section 54. The other rib 53 faces an inner peripheral surface of the plug hole 8 in the cylinder CY.

As shown in FIG. 2, the rubber seal 4 includes a rubber sealing section 41, a rubber outer peripheral section 42, and a rubber inner peripheral section 43. The rubber sealing section 41 is disposed in the outer periphery of the proximal end side portion of the high-voltage tower section 32. The rubber outer peripheral section 42 protrudes from the rubber sealing section 41, and is engaged with the outer periphery of the proximal end side portion of the pole joint 5. The rubber inner peripheral section 43 protrudes from the rubber sealing section 41 in the inner peripheral side of the rubber outer peripheral section 42, and is disposed between the inner periphery of the proximal end side portion of the pole joint 5 and an outer periphery of the high-voltage tower section 32. The rubber sealing section 41 has a shape that is attached to the opening end portion 81 of the plug hole 8 in the cylinder CY, and seals a space between the outer periphery of the high-voltage tower section 32 and the opening end portion 81 of the plug hole 8 in the cylinder CY. The inner peripheral surface of the rubber outer peripheral section 42 has a shape along a shape of the plurality of protrusion sections in the joint engagement section 52. The distal end of the rubber inner peripheral section 43 protrudes more toward the distal end side L1 than to the distal end of the high-voltage tower section 32.

Figure 4:
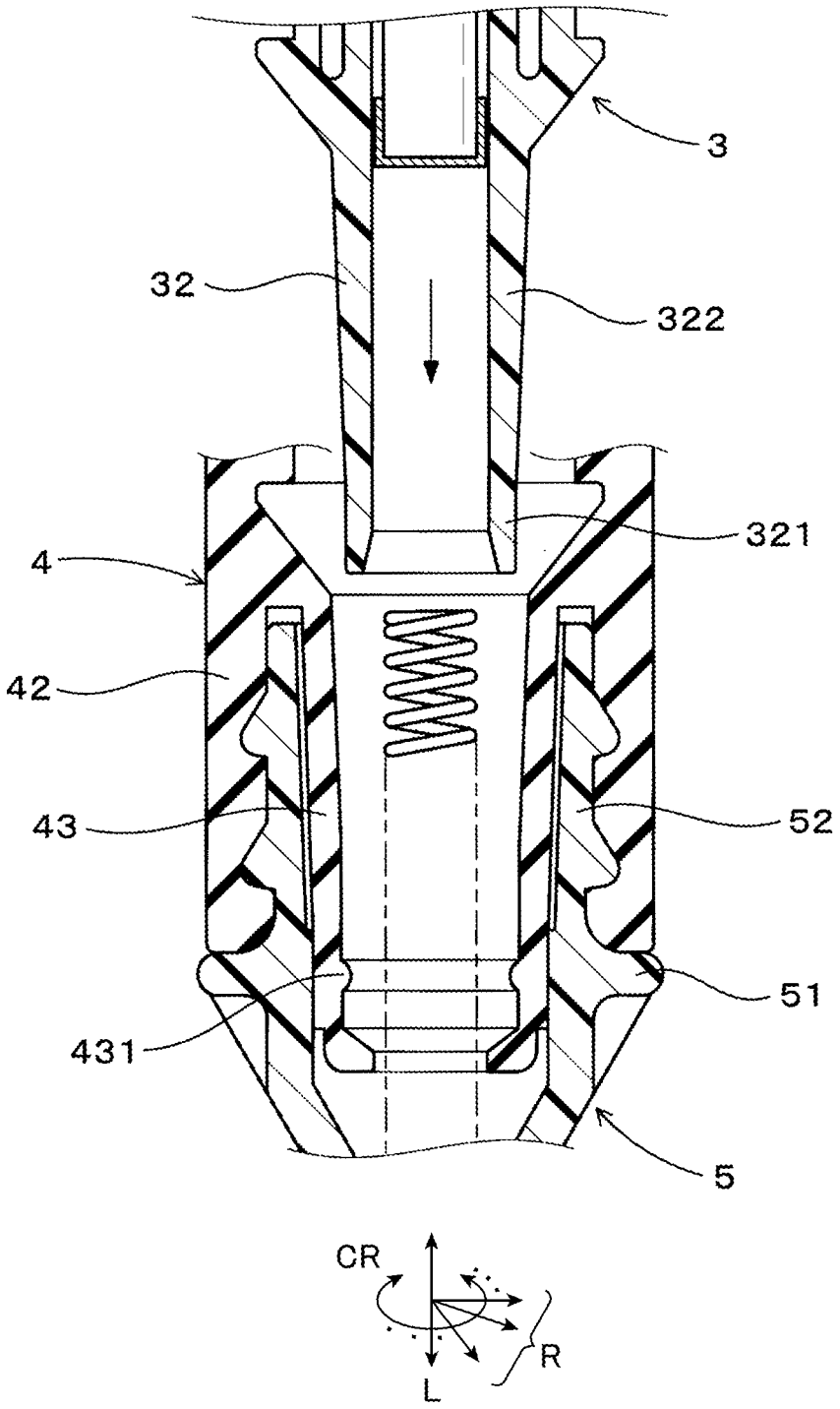
FIG. 4 is a cross-sectional view showing a state in which the high-voltage tower section is press-fitted into a rubber seal attached to a pole joint in the ignition coil for an internal combustion engine according to the embodiment.

As shown in FIGS. 3 and 4, the high-voltage tower section 32 is press-fitted into the rubber inner peripheral section 43 in the rubber seal 4. Due to the high-voltage tower section 32 press-fitted into the rubber inner peripheral section 43, the high-voltage tower section 32 and the rubber inner peripheral section 43 are adhered to each other and then, the rubber inner peripheral section 43 and a portion in which the rib 51 is formed in the pole joint 5 are adhered to each other. Thus, even when the rubber inner peripheral section 43 would otherwise freely vibrate by vibration of the engine, the rib 51 is supported on the inner peripheral surface of the plug hole 8 in the cylinder CY so that the vibration can be suppressed.

A protrusion 431 is disposed in the inner peripheral surface of the rubber seal 4 in order to reduce press-fit load of the high-voltage tower section 32 relative to the rubber inner peripheral section 43. The formed protrusion 431 abuts on the outer peripheral surface of the high-voltage tower section 32, thereby being able to reduce a contact area between the inner peripheral surface of the rubber inner peripheral section 43 of the rubber seal 4 and the outer peripheral surface of the high-voltage tower section 32. This makes it possible to facilitate a press fit of the high-voltage tower section 32 to the rubber inner peripheral section 43. Therefore, the high-voltage tower section 32 can be press-fitted into the rubber inner peripheral section 43 of the rubber seal 4 assembled to the pole joint 5 without using a lubricant such as talc.

As shown in FIGS. 3 and 4, the protrusion 431 of the present embodiment is formed annularly along the circumferential direction CR of the inner peripheral surface of the rubber inner peripheral section 43 in the rubber seal 4. The protrusion 431 is formed into an approximately semicircular cross-sectional shape.

Figure 5:
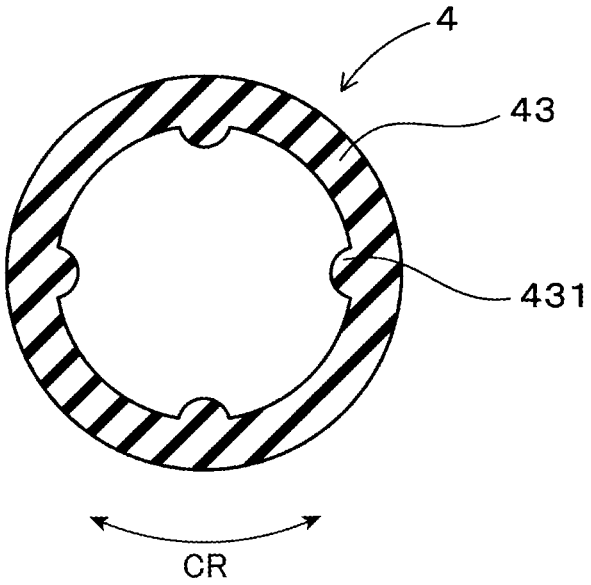
FIG. 5 is a cross-sectional view showing a rubber inner peripheral section of the other rubber seal in a state viewed from a center axis direction of a plug hole in the ignition coil for an internal combustion engine according to the embodiment.
Figure 6:
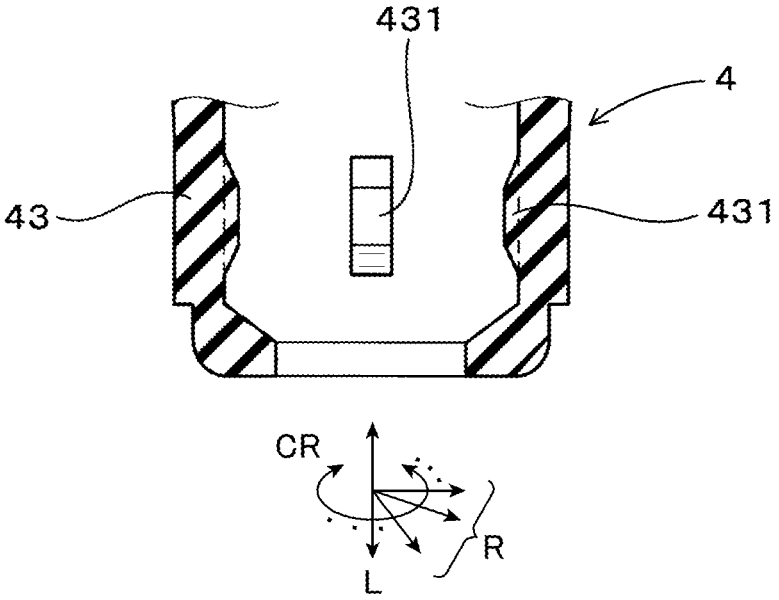
FIG. 6 is a cross-sectional view showing a rubber inner peripheral section of the other rubber seal in the ignition coil for an internal combustion engine according to the embodiment.

As shown in FIG. 5, the protrusion 431 may be formed in a state where a plurality of projections are aligned along the circumferential direction CR in the inner peripheral surface of the rubber inner peripheral section 43 of the rubber seal 4. A cross-sectional shape of the protrusion 431 may be various shapes, for example, as shown in FIG. 6, a longitudinally long shape in the center axis direction L of the plug hole 8 of the cylinder CY. The protrusion 431 may be configured by a portion other than a plurality of recessed portions that are formed in the inner periphery surface of the rubber inner peripheral section 43.

As shown in FIG. 3, the protrusion 431 of the present embodiment faces the inner peripheral side of the rib 51 via the rubber inner peripheral section 43 of the rubber seal 4. In other words, the protrusion 431 and the rib 51 are located on a virtual line C that extends from the center axis direction L of the pole joint 5 to the radial direction R. Thus, a load, generated in the radial direction R of the high-voltage tower section 32, due to vibration of the engine, can be restrained by the inner peripheral surface of the plug hole 8 of the cylinder CY via the protrusion 431 of the rubber inner peripheral section 43 and the rib 53.

The protrusion 431 disposed in the inner peripheral surface of the rubber inner peripheral section 43 faces the outer peripheral surface of the straight outer peripheral section 321. The protrusion 431 abuts on the straight outer peripheral section 321. Thus, when the high-voltage tower section 32 is press-fitted into the rubber inner peripheral section 43, the protrusion 431 can be more stably compressed.

Figure 7:
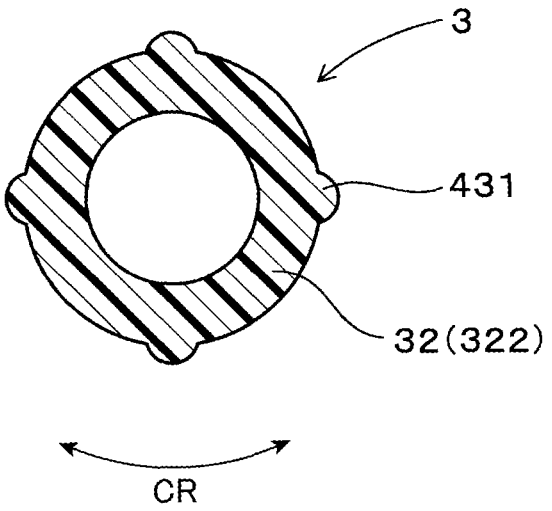
FIG. 7 is a cross-sectional view showing other high-voltage tower section in a state viewed from the center axis direction of the plug hole in the ignition coil for an internal combustion engine according to the embodiment.

As shown in FIG. 7, the protrusion 431 may be disposed in the outer peripheral surface of the straight outer peripheral section 321 of the high-voltage tower section 32. Even in this case, it is possible to obtain the same actions and effects as the case where the protrusion 431 is disposed in the inner periphery surface of the rubber inner peripheral section 43.

Figure 8:
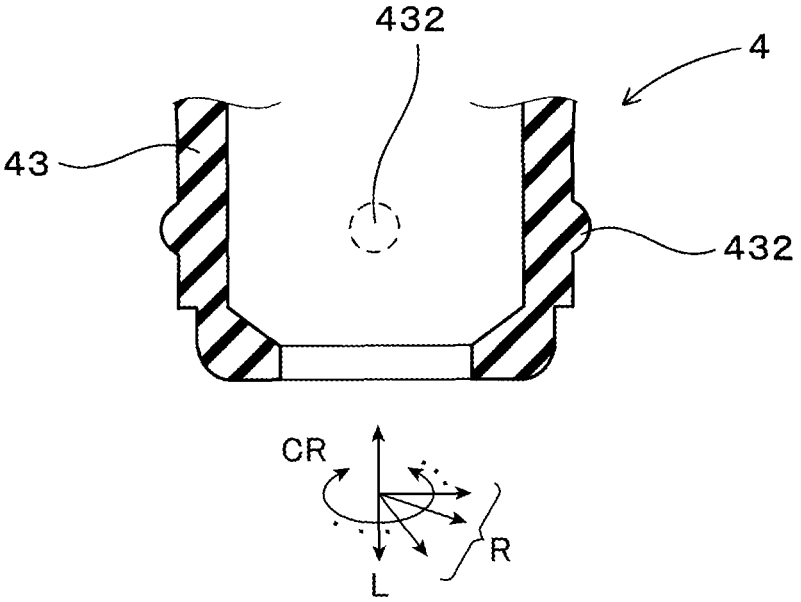
FIG. 8 is a cross-sectional view showing a rubber inner peripheral section of the other rubber seal in the ignition coil for an internal combustion engine according to the embodiment.
Figure 9:
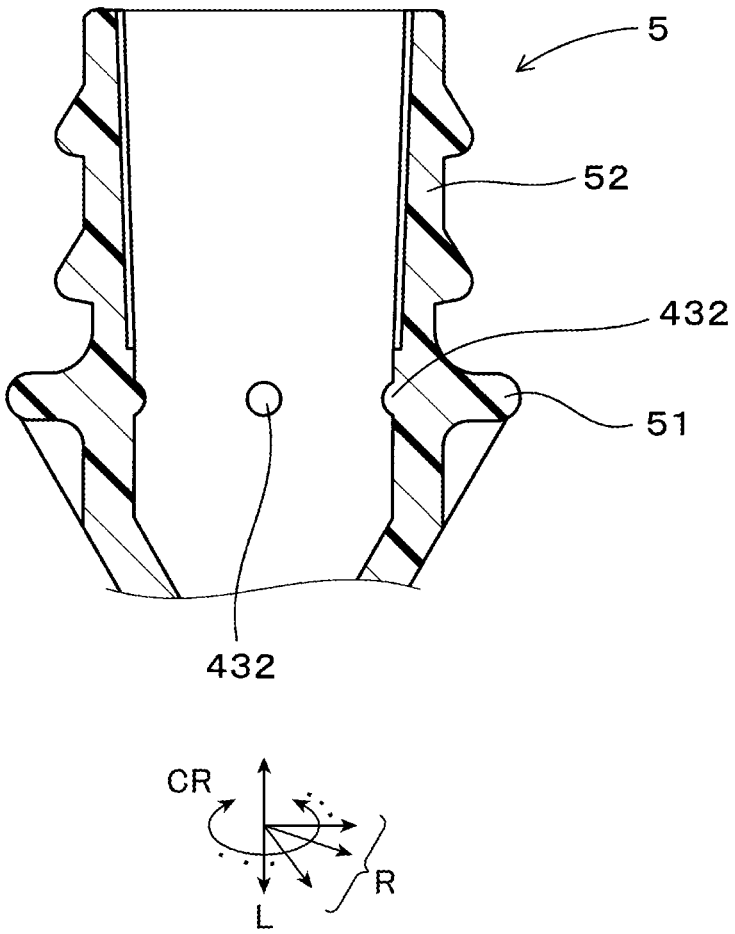
FIG. 9 is a cross-sectional view showing a part of the other pole joint in the ignition coil for an internal combustion engine according to the embodiment.

Instead of the protrusion 431 of the rubber inner peripheral section 43, as shown in FIG. 8, a protrusion 432 may be disposed in the outer periphery surface of the rubber inner peripheral section 43. As shown in FIG. 9, the protrusion 432 may be disposed in the inner peripheral surface of the pole joint 5. Even in these cases, the protrusion 432 may be disposed at a position at which the protrusion 432 faces the outer peripheral side of the straight outer peripheral section 321 and also faces the inner peripheral side of the rib 51. In these cases, the rubber inner peripheral section 43 of the rubber seal 4 assembled to the high-voltage tower section 32 can be press-fitted into the pole joint 5. The protrusion 432 can reduce a load in a case where press fit is performed.

The straight outer peripheral section 321 may not be disposed in the distal end side portion of the high-voltage tower section 32. In this case, the distal end side portion of the high-voltage tower section 32 is configured by only a tapered outer peripheral section that includes an outer peripheral surface of which a diameter is enlarged toward the proximal end side L2 in the center axis direction L of the plug hole 8 of the cylinder CY.

The distal end section of the high-voltage tower section 32 is configured by only a straight outer peripheral section that includes an outer peripheral surface that is parallel to the center axis direction L of the plug hole 8 of the cylinder CY.

In the ignition coil 1 of the present embodiment, the rib 51 is disposed in the pole joint 5 made of resin. The straight outer peripheral section 321 of the high-voltage tower section 32 in the coil case 3 made of resin faces the inner peripheral side of the rib 51 via the rubber inner peripheral section 43 of the rubber seal 4 made of rubber.

The outer diameter of the rib 51 in the pole joint 5 is formed to be slightly smaller than the inner diameter of the plug hole 8 in the cylinder CY in order to allow the rib 51 to be inserted into the plug hole 8 in the cylinder CY. In a state where the pole joint 5 is inserted into the plug hole 8 in the cylinder CY, a slight gap is formed between the rib 51 and the inner peripheral surface of the plug hole 8 in the cylinder CY. Here, when a mounting flange section in the ignition coil 1 is fastened to the engine by a bolt or the like, a center position of the ignition coil 1 relative to the plug hole 8 in the cylinder CY is slightly deviated due to the fastening force. Thus, the rib 51 of the pole joint 5 abuts on the inner peripheral surface of the plug hole 8 in the cylinder CY. As a result, the rib 51 of the pole joint 5 is supported on the inner peripheral surface of the plug hole 8 in the cylinder CY.

When the engine is operated, the ignition coil 1 is strongly vibrated by vibration generated in the engine. At this time, the rib 51 of the pole joint 5 is supported on the inner peripheral surface of the plug hole 8 in the cylinder CY. Thus, swing of the high-voltage tower section 32 disposed in the coil case 3 can be restrained by the inner peripheral surface of the plug hole 8 in the cylinder CY. In addition, the vibration of the high-voltage tower section 32 can be suppressed via the rubber seal 4. This enables the ignition coil 1 to be sufficiently strongly resistant to vibration generated in the engine.

When the ignition coil 1 is assembled, as shown in FIG. 4, the rubber seal 4 is attached to the pole joint 5 and subsequently, the high-voltage tower section 32 is press-fitted into the rubber inner peripheral section 43 of the rubber seal 4. At this time, the tapered outer peripheral section 322 of the high-voltage tower section 32 is guided in the rubber inner peripheral section 43, and the straight outer peripheral section 321 slides on the surface of the protrusion 431 of the rubber inner peripheral section 43. This makes it possible to reduce frictional resistance between the high-voltage tower section 32 and the rubber inner peripheral section 43, and to facilitate a press fit of the high-voltage tower section 32 to the rubber inner peripheral section 43. Thus, according to the ignition coil 1 of the present embodiment, its vibration resistance and assemblability can be improved.

REFERENCE SIGNS LIST

1: ignition coil for internal combustion engine
21: primary coil
22: secondary coil
23: center core
24: outer circumference core
3: coil case
31: housing section
32: high-voltage tower section
4: rubber seal
5: pole joint
51: rib
61: plug cap
7: ignition plug
8: plug hole
81: opening end portion

What is claimed is:

1. An ignition coil for an internal combustion engine, the ignition coil comprising:

a primary coil and a secondary coil;

a center core that is arranged on an inner periphery of the primary coil and the secondary coil;

an outer peripheral core that is arranged on an outer periphery of the primary coil and the secondary coil;

a coil case that is made of resin, the coil case including a housing section and a high-voltage tower section, the housing section housing the primary coil, the secondary coil, the center core, and the outer peripheral core, the housing section being arranged outside a plug hole of a cylinder for an internal combustion engine in which an ignition plug is arranged, the high-voltage tower section being disposed in the housing section such that at least a section of the high-voltage tower section is located within the plug hole;

a seal rubber that is made of rubber, the seal rubber being attached to an outer periphery of the high-voltage tower section;

a pole joint that is made of resin, the pole joint being disposed in the plug hole and attached to the high-voltage tower section via the seal rubber; and a plug cap that is made of rubber, the plug cap being attached to a distal end portion of the pole joint and attached to the ignition plug, wherein the pole joint is provided with a rib that protrudes to an outer periphery of the rib and faces an inner peripheral surface of the plug hole, and an inner peripheral side of the rib faces the high-voltage tower section via the seal rubber.

2. The ignition coil for an internal combustion engine according to claim 1, wherein:

the seal rubber includes a rubber sealing section that is arranged in an outer periphery of a proximal end side portion of the high-voltage tower section, a rubber outer peripheral section that protrudes from the rubber sealing section, the rubber outer peripheral section being engaged with an outer periphery of a proximal end side portion of the pole joint, and a rubber inner peripheral section that protrudes from the rubber sealing section in an inner peripheral side of the rubber outer peripheral section, the rubber inner peripheral section being disposed between an inner periphery of a proximal end side portion of the pole joint and an outer periphery of the high-voltage tower section; and the high-voltage tower section is press-fitted into the rubber inner peripheral section.

3. The ignition coil for an internal combustion engine according to claim 2, wherein:

a joint engagement section is disposed in a proximal end side portion of the pole joint, the joint engagement section being engaged with the rubber outer peripheral section; and the rib is disposed adjacent to the joint engagement section.

4. The ignition coil for the internal combustion engine according to claim 2, wherein:

a protrusion is disposed in at least one of an outer peripheral surface of the high-voltage tower section and an inner periphery of the rubber inner peripheral section facing the outer peripheral surface of the high-voltage tower section.

5. The ignition coil for an internal combustion engine according to claim 4, wherein:

a straight outer peripheral section that has a cylindrical shape, the straight outer peripheral section being formed in a distal end portion of the high-voltage tower section, and including an outer peripheral surface that is parallel to a center axis direction of the plug hole, a tapered outer peripheral section that has a cylindrical shape, the tapered outer peripheral section being formed in a proximal end side of the straight outer peripheral section to be adjacent to the straight outer peripheral section, and including an outer peripheral surface of which a diameter is enlarged toward the proximal end side, the protrusion is disposed in an outer peripheral surface of the straight outer peripheral section or an inner peripheral surface of the rubber inner peripheral section that faces the outer peripheral surface of the straight outer peripheral section.

6. The ignition coil for an internal combustion engine according to claim 2, wherein:

a protrusion is disposed in at least one of an outer peripheral surface of the rubber inner peripheral section and an inner peripheral surface of the pole joint that faces the outer peripheral surface of the rubber inner peripheral section.

7. The ignition coil for the internal combustion engine according to claim 6, wherein a straight outer peripheral section that has a cylindrical shape, the straight outer peripheral section being formed in a distal end portion of the high-voltage tower section, and including an outer peripheral surface that is parallel to a center axis direction of the plug hole, a tapered outer peripheral section that has a cylindrical shape, the tapered outer peripheral section being formed in a proximal end side of the straight outer peripheral section to be adjacent to the straight outer peripheral section, and including an outer peripheral surface of which a diameter is enlarged toward the proximal end side, the protrusion is disposed at a position that faces an outer peripheral side of the straight outer peripheral section in at least one of an outer peripheral surface of the rubber inner peripheral section or an inner peripheral surface of the pole joint that faces an outer peripheral surface of the rubber inner peripheral section.

8. The ignition coil for an internal combustion engine according to claim 4, wherein the projection faces an inner peripheral side of the rib.

9. The ignition coil for an internal combustion engine according to claim 6, wherein the projection faces an inner peripheral side of the rib.

10. The ignition coil for the internal combustion engine according to claim 3, wherein:

a protrusion is disposed in at least one of an outer peripheral surface of the high-voltage tower section and an inner periphery of the rubber inner peripheral section facing the outer peripheral surface of the high-voltage tower section.

11. The ignition coil for an internal combustion engine according to claim 10, wherein:

a straight outer peripheral section that has a cylindrical shape, the straight outer peripheral section being formed in a distal end portion of the high-voltage tower section , and including an outer peripheral surface that is parallel to a center axis direction of the plug hole, a tapered outer peripheral section that has a cylindrical shape, the tapered outer peripheral section being formed in a proximal end side of the straight outer peripheral section to be adjacent to the straight outer peripheral section, and including an outer peripheral surface of which a diameter is enlarged toward the proximal end side, the protrusion is disposed in an outer peripheral surface of the straight outer peripheral section or an inner peripheral surface of the rubber inner peripheral section that faces the outer peripheral surface of the straight outer peripheral section.

12. The ignition coil for an internal combustion engine according to claim 3, wherein:

a protrusion is disposed in at least one of an outer peripheral surface of the rubber inner peripheral section and an inner peripheral surface of the pole joint that faces the outer peripheral surface of the rubber inner peripheral section.

13. The ignition coil for the internal combustion engine according to claim 12, wherein a straight outer peripheral section that has a cylindrical shape, the straight outer peripheral section being formed in a distal end portion of the high-voltage tower section, and including an outer peripheral surface that is parallel to a center axis direction of the plug hole, a tapered outer peripheral section that has a cylindrical shape, the tapered outer peripheral section being formed in a proximal end side of the straight outer peripheral section to be adjacent to the straight outer peripheral section, and including an outer peripheral surface of which a diameter is enlarged toward the proximal end side, the protrusion is disposed at a position that faces an outer peripheral side of the straight outer peripheral section in at least one of an outer peripheral surface of the rubber inner peripheral section or an inner peripheral surface of the pole joint that faces an outer peripheral surface of the rubber inner peripheral section.

14. The ignition coil for an internal combustion engine according to claim 10, wherein the projection faces an inner peripheral side of the rib.

15. The ignition coil for an internal combustion engine according to claim 12, wherein the projection faces an inner peripheral side of the rib.

* * * * *